US012745839B2

(12) United States Patent
Troiano, Jr.

(10) Patent No.: US 12,745,839 B2
(45) Date of Patent: Sep. 29, 2026

(54) PORTABLE WORKSTATION FOR WRITING, DRAWING AND COLORING

(71) Applicant: Anthony Troiano, Jr., Savannah, GA (US)

(72) Inventor: Anthony Troiano, Jr., Savannah, GA (US)

( * ) Notice: Subject to any disclaimer, the term of this patent is extended or adjusted under 35 U.S.C. 154(b) by 162 days.

(21) Appl. No.: 17/744,489

(22) Filed: May 13, 2022

(65) Prior Publication Data

US 2022/0361663 A1 Nov. 17, 2022

Related U.S. Application Data

(60) Provisional application No. 63/188,844, filed on May 14, 2021.

(51) Int. Cl.

| | |
|---|---|
| ***A45C 11/36*** | (2006.01) |
| ***A45C 11/34*** | (2006.01) |
| ***A47B 23/04*** | (2006.01) |
| ***A47B 23/06*** | (2006.01) |

(52) U.S. Cl.

CPC ..... *A47B 23/06* (2013.01); *A45C 11/34* (2013.01); *A45C 11/36* (2013.01); *A47B 23/04* (2013.01)

(58) Field of Classification Search

CPC ..... A45C 11/36; A45C 11/34; A47B 13/00; B65D 5/5213; B65D 5/6614; B65D 5/667; B65D 6/6697; B65D 5/5233; B65D 5/526

USPC ..... 206/216

See application file for complete search history.

(56) References Cited

U.S. PATENT DOCUMENTS

| | | | | | |
|---|---|---|---|---|---|
| 348,124 | A | * | 8/1886 | Hood | A47B 13/00 206/214 |
| 434,040 | A | * | 8/1890 | Andrews | A47B 97/08 281/31 |
| 847,650 | A | * | 3/1907 | Corbett | B42D 3/12 281/31 |
| 1,193,181 | A | * | 8/1916 | Peck | B42D 3/12 281/31 |
| 1,205,779 | A | * | 11/1916 | Peck | B42D 3/12 281/31 |
| 1,675,406 | A | | 7/1928 | Douglas | |
| 2,205,692 | A | | 6/1940 | Johnson et al. | |

(Continued)

FOREIGN PATENT DOCUMENTS

| | | |
|---|---|---|
| FR | 2 717 998 | 10/1995 |

*Primary Examiner* — Ernesto A Grano
*Assistant Examiner* — Symren K Sanghera
(74) *Attorney, Agent, or Firm* — LaMorte & Associates P.C.

(57) ABSTRACT

A portable workstation having a box structure with a first compartment and a second compartment that are separated by a common wall. The first compartment has a first end and an opposite second end. A first panel rotates between a closed position and an open position about a first hinge connection in the first end of the first compartment. A second panel is provided that rotates between a first position and a second position. The second panel is connected to the box structure with a second hinge connection in the second end of the first compartment. The second panel contacts, and is supported by, the common wall when the second panel is rotated into its second position. The first panel contacts and locks the second panel in its second position when the second panel is in its second position and the first panel is in its closed position.

14 Claims, 5 Drawing Sheets

(56) References Cited

U.S. PATENT DOCUMENTS

| | | | | | |
|---|---|---|---|---|---|
| 2,739,825 | A | | 3/1956 | Douglas | |
| 3,136,082 | A | | 6/1964 | Sloves | |
| 4,318,471 | A | | 3/1982 | Hutton | |
| 4,420,270 | A | * | 12/1983 | Rossello | A45C 13/02 402/76 |
| 4,511,036 | A | | 4/1985 | Castelli | |
| 5,377,794 | A | | 1/1995 | Book | |
| 5,388,689 | A | * | 2/1995 | Kroop | B42D 1/00 206/214 |
| 7,694,932 | B1 | | 4/2010 | Ngan | |
| 9,167,926 | B1 | * | 10/2015 | Helmuth | A47G 19/03 |
| 2004/0108370 | A1 | * | 6/2004 | Lee | B65D 5/5213 229/120.21 |
| 2008/0296179 | A1 | * | 12/2008 | Stukenkemper | A45C 11/34 206/214 |
| 2009/0026210 | A1 | * | 1/2009 | Chan | B25H 3/003 220/529 |
| 2017/0349362 | A1 | * | 12/2017 | Chatelain | B65D 5/6608 |

* cited by examiner

PORTABLE WORKSTATION FOR WRITING, DRAWING AND COLORING

RELATED APPLICATIONS

This application claims the benefit of U.S. Provisional Patent Application No. 63/188,844, filed May 14, 2021.

BACKGROUND OF THE INVENTION

1. Field of the Invention

In general, the present invention relates to unfolding workstations that are used to hold a supply of paper, art supplies and writing supplies. More particularly, the present invention relates to folding workstations that store paper, art supplies, writing supplies and also provide a work surface for utilizing the paper, art supplies and writing supplies.

2. Prior Art Description

In the past, pens, ink, and paper were considered expensive luxuries. Accordingly, such materials were often sold and carried in specialized boxes. The boxes protected the expensive products from becoming lost or damaged. For example, in U.S. Pat. No. 348,124 to Hood, a specialized box for holding ink and pens is disclosed. The box also holds paper and provides a flat surface for writing.

In more modern times, most paper, ink and writing implements are considered inexpensive commodities. Accordingly, specialized boxes are rarely used. Rather, specialized boxes are used primarily for calligraphy or painting sets. Such prior art is exemplified in U.S. Pat. No. 7,694,932 to Ngan and U.S. Pat. No. 1,193,181 to Peck. Both patents show boxes that are used to hold painting supplies, wherein the box also serves as an easel that can hold paper.

In modern society, individuals, such as toddlers and school children, use writing supplies and art supplies, either for learning or for leisure activities. Often, the writing supplies or art supplies are carried in a pencil box or pouch. Paper pads, coloring books and the like are often carried separately. To write, color, or draw, an individual must find a smooth flat surface to place the paper or coloring book. The individual must then continuously search through a pencil box to get the pen, pencil, marker, or crayon desired. This makes the activities of writing, drawing, and coloring more difficult in locations such as cars, planes, park benches, and other places that lack ample space to lay out supplies.

A need therefore exists for an improved portable carrying case that meets modern needs, wherein the portable carrying case can hold paper, pencils, pens, markers, crayons, and the like in a neat and organized manner while also providing a smooth flat surface upon which to work. This need is by the present invention as described and claimed below.

SUMMARY OF THE INVENTION

The present invention is a portable workstation for children's activities. The workstation has a box structure with a first compartment and a second compartment. The first compartment and the second compartment are separated by a common wall. The first compartment has an open top, a first end that is distally positioned away from the common wall and an opposite second end proximate the common wall. The second compartment is taller than the first compartment and has its own lid.

A first panel is provided that selectively rotates between a closed position and an open position. In the closed position, the first panel covers the open top of the first compartment. In the open position, the first panel enables access to the first compartment. The first panel is connected to the box structure with a first hinge connection. The first hinge connection is in the first end of the first compartment. The first hinge connection has a first hinge axis that is parallel to the common wall.

A second panel is provided that selectively rotates between a first position and a second position. In the first position, the second panel covers the open top of the first compartment. In the second position, the second panel enables access to the first compartment. The second panel is connected to the box structure with a second hinge connection. The second hinge connection is disposed in the second end of the first compartment. The second hinge connection has a second hinge axis that is parallel to both the common wall and the first hinge axis of the first hinge connection. The second panel contacts, and is supported by, the common wall when the second panel is rotated about the second hinge axis into its second position. The first panel contacts and locks the second panel in its second position when the second panel is in its second position and the first panel is in its closed position.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered a limitation when interpreting the scope of the appended claims.

Figure 1:
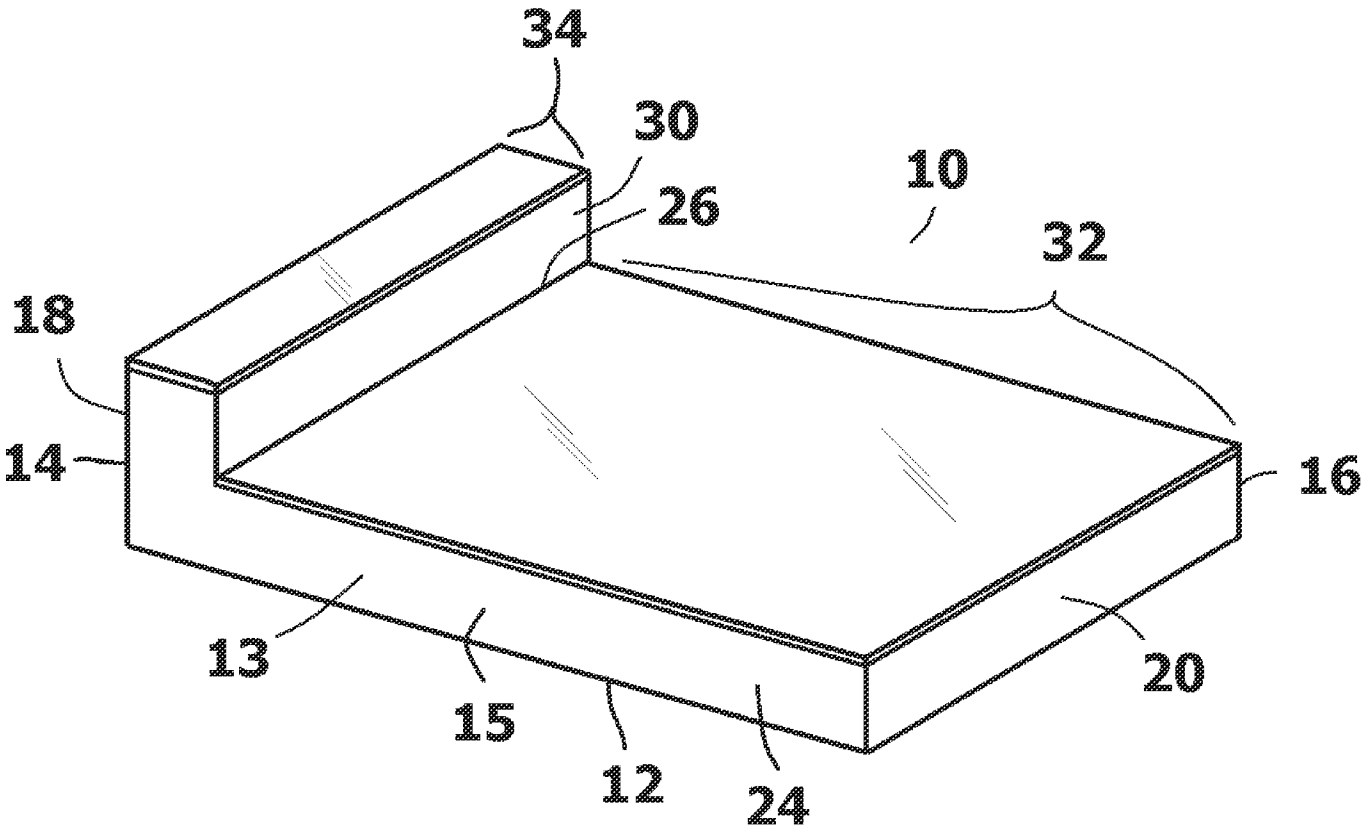
FIG. 1 is an exemplary embodiment of the present invention workstation in a fully closed configuration.

Referring to FIG. 1, a portable children's workstation 10 is shown. As will be explained, the purpose of the portable workstation 10 is to store paper, art supplies, writing supplies and also provide working surfaces for utilizing those supplies. In this manner, an individual can easily carry and utilize such supplies in places where a flat working surface may not be readily available.

The portable workstation 10 includes a flat bottom surface 12. Side surfaces 13 extend upwardly from the periphery of the bottom surface 12 to form a base box 14. The side surfaces 13 of the base box 14 include two side walls 15, 16, a rear wall 18, and a front wall 20. The base box 14 can be made from plastic, wood, cardboard, or any other material capable of maintaining its shape and integrity while being carried with an internal load.

The side surfaces 13 of the base box 14 are not square. Rather, the side walls 15, 16 of the base box 14 are L-shaped. As such, each of the side walls 15, 16 has a tall section 22 and a short section 24. On each side wall 15, 16, the short section 24 meets the tall section 22 along a transition plain 26. Within the base box 14, a dividing wall 30 extends along the transition plane 26, therein separating the tall section 22 from the short section 24. The dividing wall 30 divides the base box 14 into two compartments. The first compartment 32 is the shorter of the two compartments and is defined between the short sections 24 of the side walls 15, 16, the front wall 20 and the dividing wall 30. The second compartment 34 is the taller of the two compartments and is defined between the tall sections 22 of the side walls 15, 16, the rear wall 18 and the dividing wall 30. Preferably, the taller second compartment 34 is at least twice as tall as the shorter first compartment 32.

Figure 2:
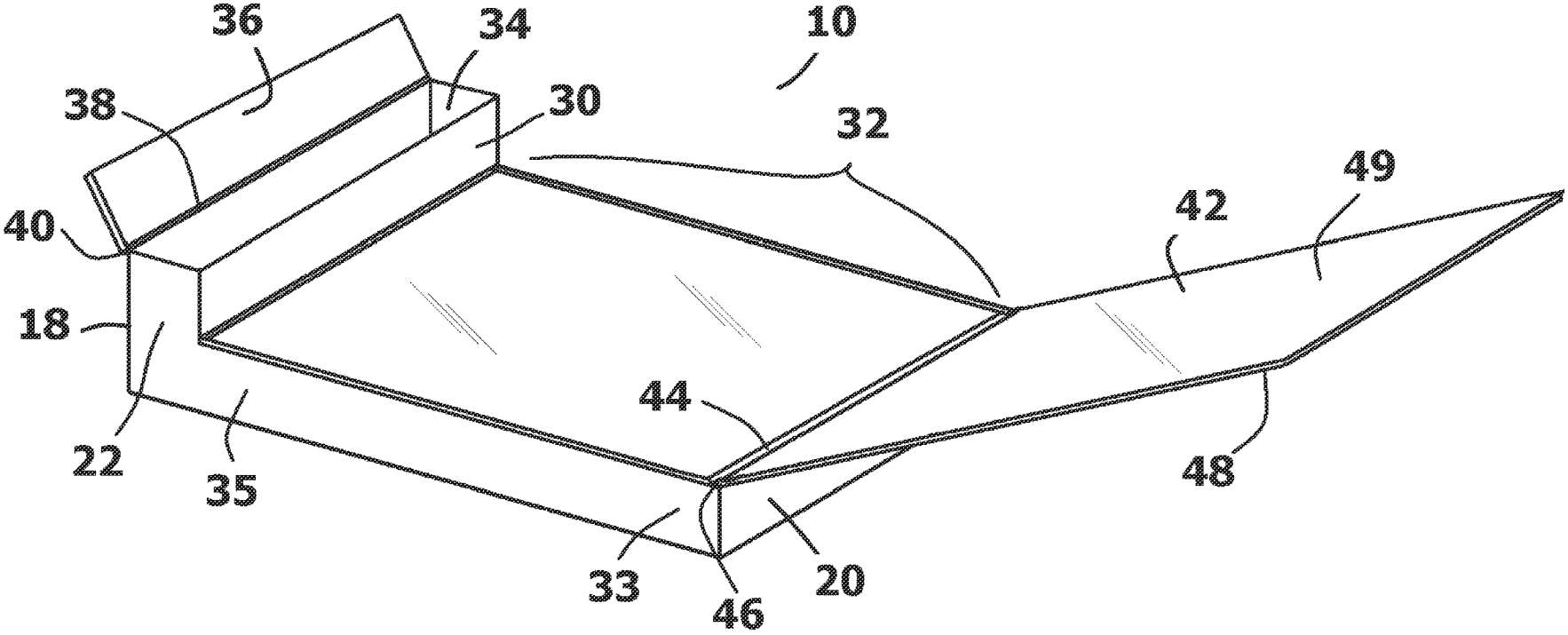
FIG. 2 shows the exemplary embodiment of FIG. 1 with a first panel and a compartment lid moved to open configurations.

Referring to FIG. 2 in conjunction with FIG. 1, it can be seen that both the first compartment 32 and the second compartment 34 have lids that can be selectively opened and closed. The taller second compartment 34 has a traditional lid 36 that is connected to the top edge 38 of the rear wall 18 with a hinged connection 40. This enables the lid 36 to be selectively opened in a direction away from the shorter first compartment 32. The taller second compartment 34 has a height equal in length to the height of the tall sections 22 of the side walls 15, 16. In this manner, the taller second compartment 34 can be used to hold various elongated art supplies, such as pencils, pens, markers, and paint brushes in the traditional manner of a pencil box.

The shorter first compartment 32 has a first end 33 proximate the front wall 20 and an opposite second end 35 proximate the common dividing wall 30. The first compartment 32 has a first panel 42 that forms its lid. In the illustrated embodiment, the first panel 42 is connected to the top edge 44 of the front wall 20 with a hinge connection 46. This enables the first panel 42 to be selectively moved in a direction away from the tall second compartment 34 from a closed first position to a second open position and back. The hinge connection 46 can be located anywhere in the first end 33 of the first compartment 32. As such, the first panel 42 can be attached to the side walls 15, 16 near the front wall 20, therein enabling the first panel 42 to rotate between the same closed first position and second open position as are illustrated. The first panel 42 has a flat top surface 48 and a flat bottom surface 49. Both the flat top surface 48 and the flat bottom surface 49 have a preferred area of at least eleven inches by eight and a half inches. In this manner, both the flat top surface 48 and the flat bottom surface 49 are capable of fully supporting a standard piece of office paper.

Figure 3:
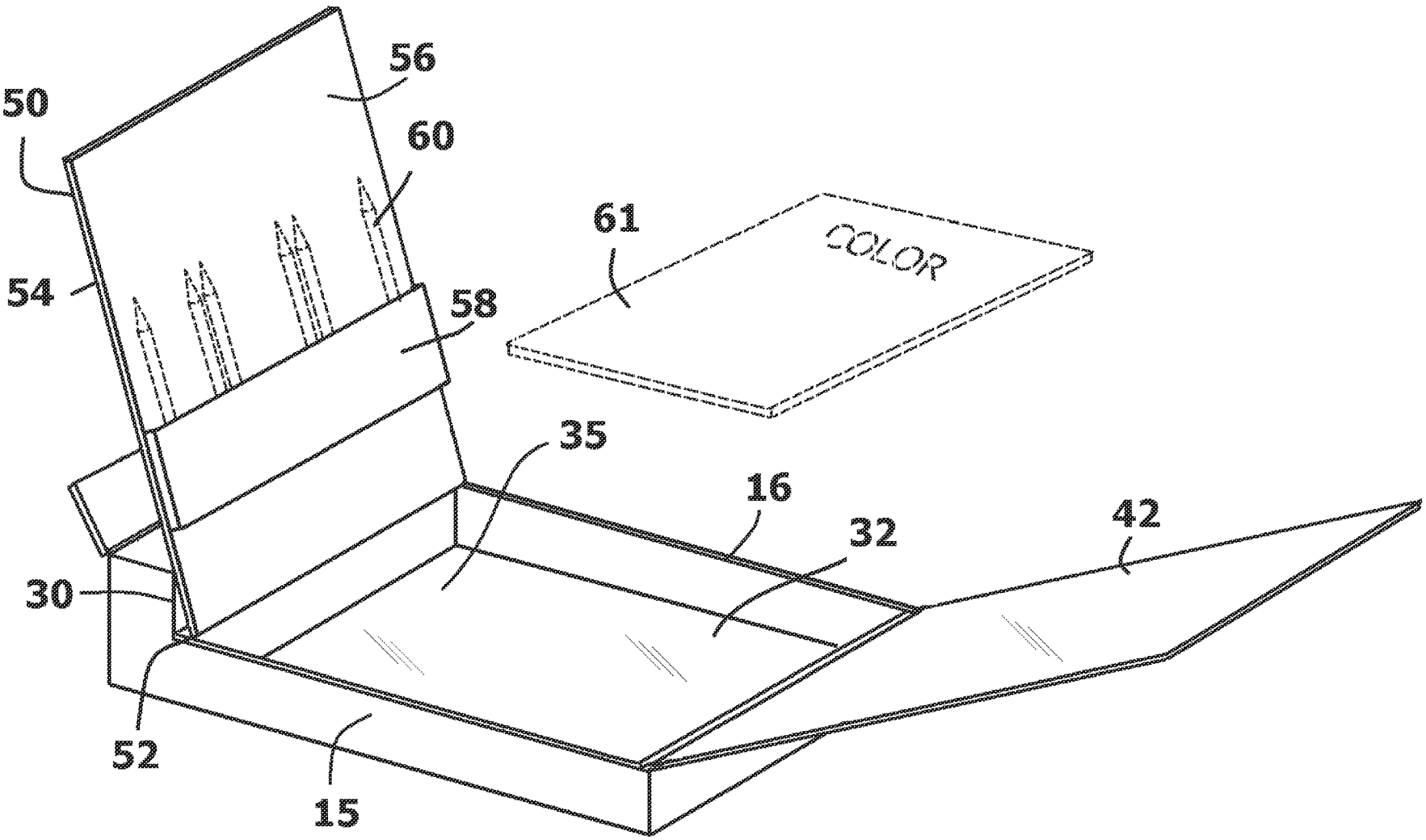
FIG. 3 shows the exemplary embodiment of FIG. 2 with the second panel moved to an open configuration.

Referring to FIG. 3 in conjunction with FIG. 1 and FIG. 2, it can be seen that a second panel 50 is positioned under the first panel 42 in the first compartment 32. In the illustrated embodiment, the second panel 50 is connected to the side walls 15, 16 near the common dividing wall 30 with a second hinge connection 52. The second hinge connection 52 enables the second panel 50 to rotate out of the first compartment 32 in the opposite direction of the first panel 42. The second panel 50 rotates about the second hinge connection 52 between a closed first position, where it covers the first compartment 32, and an open second position, where the first compartment 32 is accessible. It will be understood that the second hinge connection 52 can be anywhere in the second end 35 of the first compartment 32. Accordingly, the second panel 50 can alternately be connected directly to the dividing wall 30 and still be able to move in the manner illustrated.

The second panel 50 has a top surface 54 and a bottom surface 56. The top surface 54 is flat and smooth. The bottom surface 56 contains one or more pockets 58, or other conventions for holding writing and marking implements 60, such as pens, pencils, markers, and crayons. The pockets 58 hold the writing and marking implements 60 in an organized manner, so that the writing and marking implements 60 can be organized by size, type and/or color.

As can be seen from FIG. 3, when the first panel 42 is rotated to its open second position, the second panel 50 becomes free to rotate to its open second position. As the second panel 50 moves to its open second position, the second panel 50 rotates until it rests against the common dividing wall 30. In this second open position, the second panel 50 is rotated between ten degrees and twenty degrees beyond vertical. Furthermore, in the second open position, the pockets 58 on the second panel 50 are exposed and the writing and marking implements 60 are easily accessed. In addition, with the first panel 42 and the second panel 50 rotated to second open positions, the interior of the first compartment 32 is exposed. The interior of the first compartment 32 is large enough to hold materials 61, such as paper, a drawing pad, a coloring book, a journal, or the like.

Figure 4:
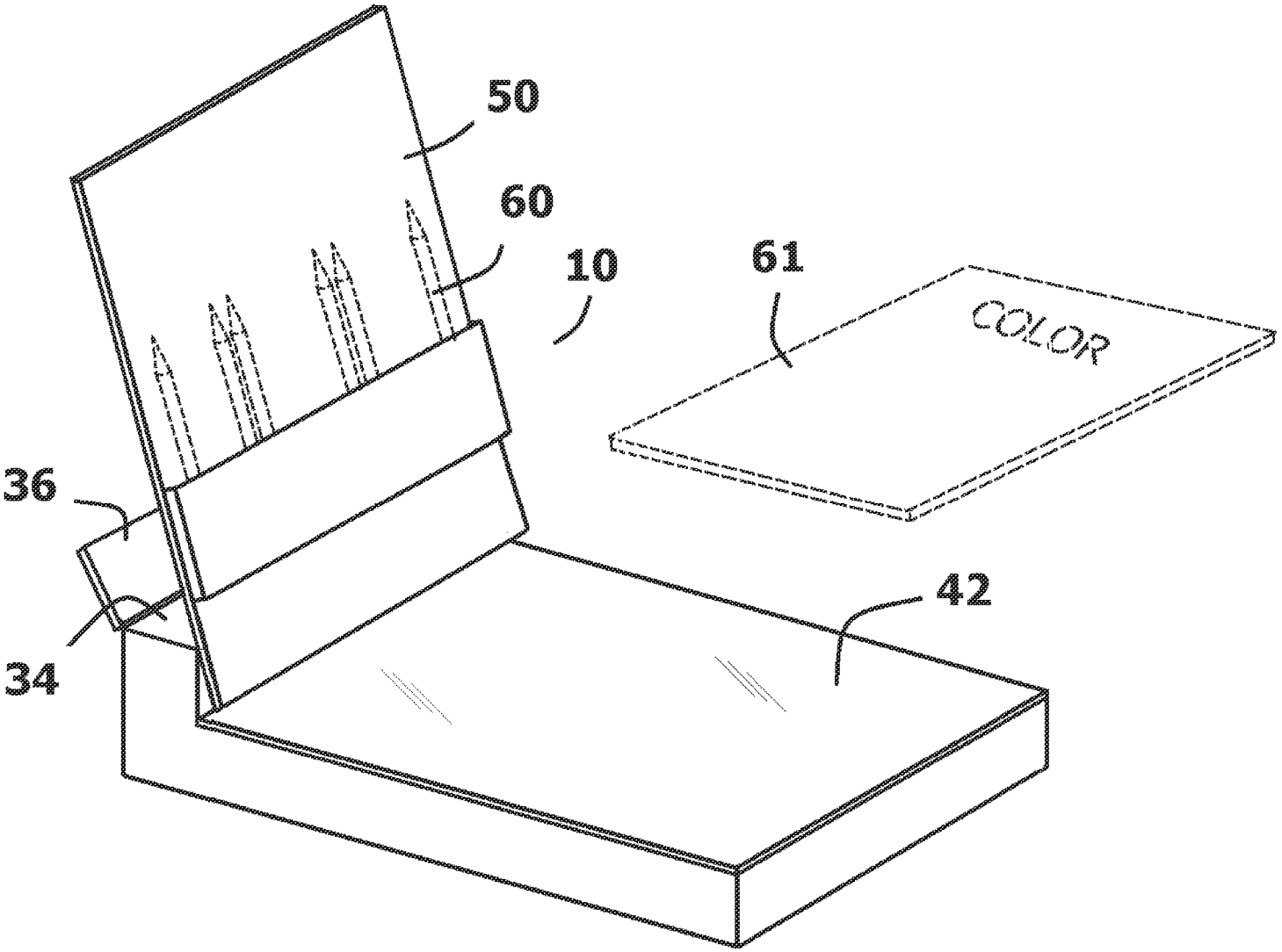
FIG. 4 shows the exemplary embodiment of FIG. 3 with the first panel moved to a closed configuration and locking the second panel in place.

Referring to FIG. 4 in conjunction with FIG. 3, it can be seen that the first panel 42 can be rotated back to its closed first position while the second panel 50 is still in its open second position. When the first panel 42 is rotated closed, the first panel 42 contacts the second panel 50 and locks the second panel 50 into its open second configuration. The first panel 42 can then be used as a work surface. Materials 61, such as paper or a coloring book, can be placed on the first panel 42. A person can then use the writing and marking implements 60 that are ergonomically supported next to the work surface by the open second panel 50. Since the second panel 50 is locked open by the first panel 42, the second panel 50 will not move as the writing and marking implements 60 are repeatedly taken from, and returned to, the second panel 50. Furthermore, since the lid 36 of the taller second compartment 34 opens away from the second panel 50, a person is free to access any supplies held in the taller second compartment 34.

Referring to FIG. 4, FIG. 3, and FIG. 2, it will be understood that after writing, drawing, or coloring is complete, the above-described opening process is reversed. The first panel 42 is rotated to its open second position. This releases the second panel 50 and provides access to the first compartment 32. Materials 61 are stored in the first compartment 32 and the second panel 50 is rotated to its closed first position. The first panel 42 is then rotated over the second panel 50, therein isolating the first compartment 32. The lid 36 of the second compartment 34 is closed and the overall workstation 10 is secure and ready for transport.

Figure 5:
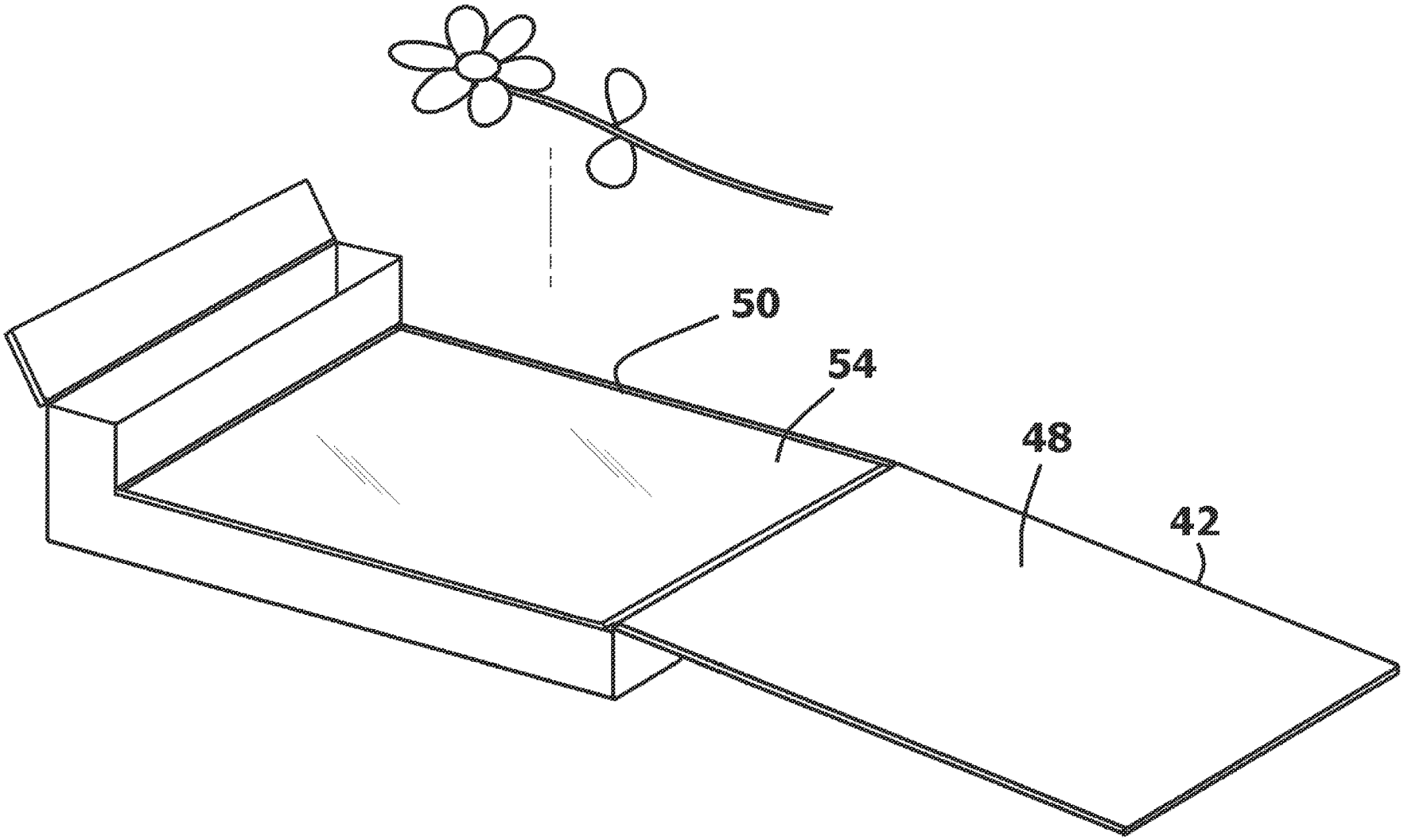
FIG. 5 shows the exemplary embodiment of FIG. 3 with the panels configured to create an enlarged working surface.

Referring to FIG. 5, it will also be understood that the top surface 54 of the second panel 50 and the bottom surface 49 of the first panel 42 can also be used to make an extended work surface. Both surfaces are flat and can be aligned to create a large work surface. Furthermore, a work in progress can be safely stored and held flat between the first panel 42 and the second panel. Likewise, a secondary object, such as a flower can be incorporated into the artwork by being pressed between the first panel 42 and the second panel 50. This keeps delicate art and objects flat and isolated when not being worked upon.

It will be understood that the embodiment of the present invention that is illustrated and described is merely exemplary and that a person skilled in the art can make many variations to that embodiment. For instance, the length, width, and height of the invention can be altered to the needs of the manufacturer or to the user. Furthermore, it will be understood that a variety of handles, latches and knobs can be used to help secure the workstation 10 and its various lids and panels. All such embodiments are intended to be included within the scope of the present invention as defined by the appended claims.

What is claimed is:

1. A portable workstation for children's activities, comprising:

a box structure having a first compartment and a second compartment, wherein said first compartment and said second compartment are separated by a common wall, and wherein said first compartment has an open top, a first end distal from said common wall, and a second end proximate said common wall;

a first panel that selectively rotates from a closed position that covers said open top of said first compartment to an open position, wherein said first panel is connected to said box structure with a first hinge connection in said first end of said first compartment, wherein said first hinge connection has a first hinge axis that is parallel to said common wall;

a second panel connected to said box structure with a second hinge connection in said second end of said first compartment, said second hinge connection having a second hinge axis that is parallel to said common wall, wherein said second panel rotates about said second hinge connection between a first position that covers said open top of said first compartment and a second position where said second panel contacts said common wall; wherein said first panel contacts said second panel prevents said second panel from moving out of said second position when said second panel is in said second position and said first panel is in said closed position.

2. The portable workstation according to claim 1, wherein said first panel in said closed position overlaps said second panel in said first position.

3. The portable workstation according to claim 1, wherein said second compartment is taller than said first compartment.

4. The portable workstation according to claim 3, wherein said second compartment is at least twice as tall as said first compartment.

5. The portable workstation according to claim 1, wherein said second panel has a bottom surface that is exposed when said second panel is in said second position, wherein pockets are coupled to said bottom surface.

6. The portable workstation according to claim 1, wherein said first panel has a flat top surface and a flat bottom surface.

7. The portable workstation according to claim 1, wherein said second compartment has a lid that is separate and distinct from said first panel and said second panel.

8. A portable workstation for children's activities, comprising:

a box structure having a first compartment and a second compartment, wherein said first compartment and said second compartment are separated by a common wall, and wherein said first compartment has an open top, a first end distal from said common wall, and a second end proximate said common wall;

a first panel that selectively rotates from a closed position that covers said open top of said first compartment to an open position;

a second panel that selectively rotates from a first position that covers said open top of said first compartment to a second position, wherein said second panel contacts, and is supported by, said common wall when said second panel is rotated into said second position, wherein said first panel contacts said second panel and prevents said second panel from moving out of said second position when said second panel is in said second position and said first panel is in said closed position.

9. The portable workstation according to claim 8, wherein said first panel in said closed position completely overlaps said second panel in said first position.

10. The portable workstation according to claim 8, wherein said second compartment is taller than said first compartment.

11. The portable workstation according to claim 10, wherein said second compartment is at least twice as tall as said first compartment.

12. The portable workstation according to claim 8, wherein said second panel has a bottom surface that is exposed when said second panel is in said second position, wherein pockets are coupled to said bottom surface.

13. The portable workstation according to claim 8, wherein said first panel has a flat top surface and a flat bottom surface.

14. The portable workstation according to claim 8, wherein said second compartment has a lid that is separate and distinct from said first panel and said second panel.

* * * * *